US009251710B2

(12) United States Patent
Wang et al.

(10) Patent No.: US 9,251,710 B2
(45) Date of Patent: Feb. 2, 2016

(54) AIR TRAFFIC ANALYSIS USING A LINEAR INEQUALITIES SOLVER

(75) Inventors: Paul T. R. Wang, Potomac, MD (US); William P. Niedringhaus, Sterling, VA (US); Matthew McMahon, Arlington, VA (US)

(73) Assignee: The MITRE Corporation, McLean, VA (US)

( * ) Notice: Subject to any disclaimer, the term of this patent is extended or adjusted under 35 U.S.C. 154(b) by 0 days.

(21) Appl. No.: 13/250,572

(22) Filed: Sep. 30, 2011

(65) Prior Publication Data

US 2013/0085660 A1 Apr. 4, 2013

(51) Int. Cl.
*G08G 5/00* (2006.01)

(52) U.S. Cl.
CPC ..... *G08G 5/0043* (2013.01)

(58) Field of Classification Search
CPC ... G08G 5/0021; G08G 5/065; G08G 5/0013; G08G 5/0043; G08G 5/0082
USPC ..... 701/4, 9, 13, 14, 120, 121, 117; 340/59, 340/203, 963; 455/456.3; 715/786
See application file for complete search history.

(56) References Cited

U.S. PATENT DOCUMENTS

| | | | | |
|---|---|---|---|---|
| 5,961,568 | A * | 10/1999 | Farahat | 701/120 |
| 6,393,358 | B1 * | 5/2002 | Erzberger et al. | 701/120 |
| 6,604,044 | B1 * | 8/2003 | Kirk | 701/120 |
| 7,561,946 | B1 * | 7/2009 | Schipper | 701/8 |
| 2009/0005960 | A1 * | 1/2009 | Roberts et al. | 701/120 |
| 2009/0105935 | A1 * | 4/2009 | Jha et al. | 701/120 |
| 2010/0141481 | A1 * | 6/2010 | O'Flynn | 340/970 |
| 2011/0208376 | A1 * | 8/2011 | Mere et al. | 701/14 |
| 2011/0260908 | A1 * | 10/2011 | New et al. | 342/59 |
| 2012/0209457 | A1 * | 8/2012 | Bushnell | 701/13 |

OTHER PUBLICATIONS

13250572, NPL, Paul T R Wang, "Solving Linear Programming Problems in Self-dual Form with the Principle of Minimax".*

Niedringhaus, William P., "Stream Option Manager (SOM): Automated Integration of Aircraft Separation, Merging, Stream Management, and Other Air Traffic Control Functions," *IEEE Transactions on Systems, Man, and Cybernetics*, 25:9:1269-1280, IEEE Publications, United States (Sep. 1995) (12 pages).

(Continued)

*Primary Examiner* — Helal A Algahaim
*Assistant Examiner* — Jelani Smith
(74) *Attorney, Agent, or Firm* — Sterne, Kessler, Goldstein & Fox P.L.L.C.

(57) ABSTRACT

Computer-implemented methods, systems, and computer readable mediums for solving large systems of linear equations, such as for aircraft traffic control and analysis, are disclosed. A method for aircraft traffic control, includes receiving as input, airspace sector information and aircraft traffic information, configuring a homogeneous system of linear inequalities comprising a plurality of linear inequalities based upon the airspace sector information and the aircraft traffic information, and resolving the homogeneous linear system to determine a second airspace sector information and a second aircraft traffic information, wherein the second airspace sector information and the second aircraft traffic information are based upon a predetermined future point of time, and wherein the resolving includes at least one of reducing a maximum infeasibility of the homogeneous linear system and reducing a sum infeasibility of the homogeneous linear system.

21 Claims, 11 Drawing Sheets

(56) References Cited

OTHER PUBLICATIONS

Niedringhaus, William P., and Lacher, Andrew R., "Initial *airspace*Analyzer Evaluation of Impact of an Unmanned Aircraft Operating in Class A Airspace," Invited Session on Air Traffic Control Systems Theory IEEE Conference on Decision and Control 2010, Technical Paper, The MITRE Corporation, United States (2010) (8 pages).

Wang, Paul T. R., "Solving Linear Programming Problems in Self-dual Form with the Principle of Minmax," Civil Systems Division, The MITRE Corporation, United States (Jul. 1989) (29 pages).

* cited by examiner

```
\ 375168
\ Scenario: S_ninety_smallLP_130
Maximize
obj:
 + 0.99999949 xa30__1 - 0.00100100 ya30__1 + 1.00000000 ya30__2 -6000.00000000 dSepP__1__2
 -4000.00000000 dSepL__1__2 -6000.00000000 dSepZ__1__2
Subject To
hSpdBk30a__1_1n: + 0.99999949 xa30__1 - 0.00100100 ya30__1>= 0.53856326
hSpdLF30a__1_1n: + 0.96069908 xa30__1 + 0.27759192 ya30__1<= 0.66320703
hSpdLf30a__1_1n: + 0.99566980 xa30__1 + 0.09296045 ya30__1<= 0.59243760
hSpdRt30a__1_1n: + 0.99548169 xa30__1 - 0.09495360 ya30__1<= 0.50777225
hSpdRT30a__1_1n: + 0.96014141 xa30__1 - 0.27951468 ya30__1<= 0.41220067
vSpdEq_30a__1_1: + 1.00000000 za30__1= 0.31000000
hSpdBk30a__2_1n: + 1.00000000 ya30__2>= 0.53600000
hSpdLF30a__2_1n: - 0.27855344 xa30__2 + 0.96042072 ya30__2<= 0.40991345
hSpdLf30a__2_1n: - 0.09395707 xa30__2 + 0.99557624 ya30__2<= 0.50528625
hSpdRt30a__2_1n: + 0.09395707 xa30__2 + 0.99557624 ya30__2<= 0.58984762
hSpdRT30a__2_1n: + 0.27855344 xa30__2 + 0.96042072 ya30__2<= 0.66061155
vSpdEq_30a__2_1: + 1.00000000 za30__2= 0.31000000
SEPh__0__1__2_0nb: - 0.00381104 xa30__2 - 0.00546995 ya30__2 + 1.00000000 dSepP__1__2>= -
0.03022046
SEPh_30__1__2_1ne: + 0.57165712 xa30__1 + 0.82049261 ya30__1 - 0.57165712 xa30__2 - 0.82049261
ya30__2
 + 1.00000000 dSepP__1__2>= 0.01120000
Bounds
    xa30__1 free
    ya30__1 free
    xa30__2 free
    ya30__2 free
End
```

212

214

216

FIG. 2B

AIR TRAFFIC ANALYSIS USING A LINEAR INEQUALITIES SOLVER

BACKGROUND OF THE INVENTION

1. Field of the Invention

The present invention relates generally to computer-implemented methods of solving systems of linear inequalities as a generic linear inequalities solver, and more particularly to air traffic analysis and control using a system of linear inequalities.

2. Background

Air traffic analysis and control can be represented as a problem that includes numerous linear variables and constraints. A simple example is documented Niedringhaus, "Stream Option Manager (SOM): Automated Integration of Aircraft Separation, Merging, Stream Management, and Other Air Traffic Control Functions" IEEE Transactions on Systems, Man, and Cybernetics, Vol. 25, No. 9, September 1995. Variables include the horizontal and vertical positions of aircraft at future times. Constraints for each aircraft include miles-in-trail spacing, due to airspace sector boundaries, sector entry/exit guidelines, aircraft capabilities, and separation from other aircraft. The number of variables and constraints grows with the number of aircraft.

The runtime for conventional methods of solving systems of linear inequalities grows as the cube of the number of aircraft, which may make it impractical to use these methods for, say, the entire Continental US (CONUS) airspace.

Therefore, efficient and accurate methods and systems for solving large systems of linear equations are needed.

SUMMARY OF EMBODIMENTS OF THE INVENTION

Efficient and accurate computer-implemented methods and systems for solving large system of linear inequalities, such as for aircraft traffic control and analysis, are disclosed. A method for aircraft traffic control includes, receiving airspace sector information and aircraft traffic information as input, configuring a homogeneous system of linear inequalities based upon the airspace sector information and the aircraft traffic information, and resolving the homogeneous system of linear inequalities to determine a second airspace sector information and a second aircraft traffic information, wherein the second airspace sector information and the second aircraft traffic information are based upon a predetermined future point of time, and wherein the resolving includes at least one of reducing a maximum infeasibility of the homogeneous system of linear inequalities and reducing a sum infeasibility of the homogeneous system.

A system for aircraft traffic control includes a processor and a linear inequalities solver configured for execution on the processor. The linear inequalities solver is further configured to receive as input, airspace sector information and aircraft traffic information, configure a homogeneous system of linear inequalities based upon the airspace sector information and the aircraft traffic information, and resolve the homogeneous system of linear inequalities to determine a second airspace sector information and a second aircraft traffic information, wherein the second airspace sector information and the second aircraft traffic information are based upon a predetermined future point of time, and wherein the resolving includes at least one of reducing a maximum infeasibility of the homogeneous system of linear inequalities and reducing a sum infeasibility of the homogeneous system of linear inequalities.

A computer readable media storing instructions wherein the instructions, when executed by a processor, are adapted to cause the processor to determine air traffic control information with a method including receiving as input, airspace sector information and aircraft traffic information, configuring a homogeneous system of linear inequalities comprising a plurality of linear inequalities based upon the airspace sector information and the aircraft traffic information, and resolving the homogeneous system of linear inequalities to determine a second airspace sector information and a second aircraft traffic information, wherein the second airspace sector information and the second aircraft traffic information are based upon a predetermined future point of time, and wherein the resolving includes at least one reducing a maximum infeasibility of the homogeneous system of linear inequalities and reducing a sum infeasibility of the homogeneous system of linear inequalities.

Further features and advantages of the present invention, as well as the structure and operation of various embodiments thereof, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

FIG. 2B is a part of a linear program configuration according to an embodiment of the present invention.

Figure 1:
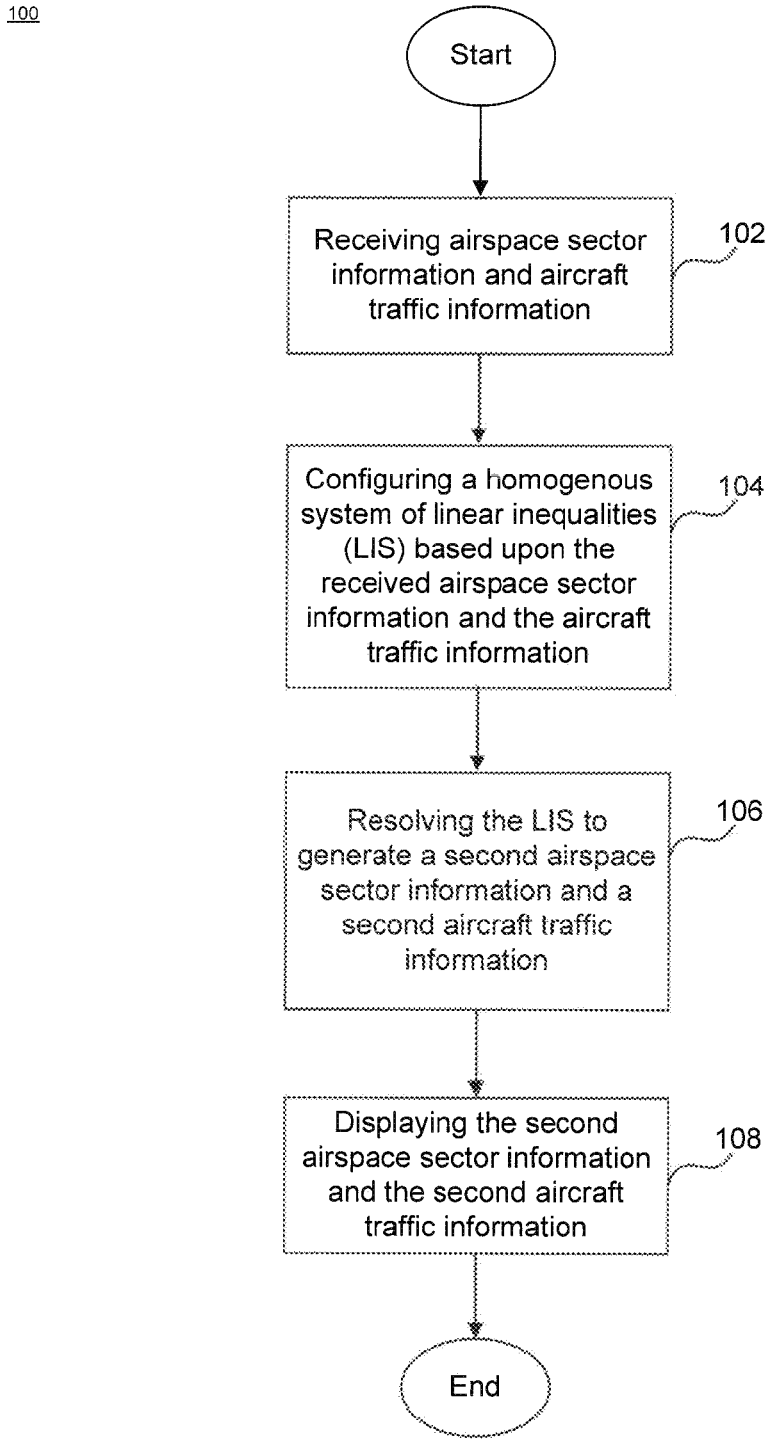
FIG. 1 is a flowchart of a method for air traffic analysis using linear inequalities solving to solve a homogeneous system of linear inequalities, according to an embodiment of the present invention.

The features and advantages of the present invention will become more apparent from the detailed description set forth below when taken in conjunction with the drawings. In the drawings, like reference numbers generally indicate identical, functionally similar, and/or structurally similar elements. Generally, the drawing in which an element first appears is indicated by the leftmost digit(s) in the corresponding reference number.

DETAILED DESCRIPTION OF THE INVENTION

While the present invention is described herein with reference to illustrative embodiments for particular applications, it should be understood that the invention is not limited thereto. Those skilled in the art with access to the teachings herein will recognize additional modifications, applications, and embodiments within the scope thereof and additional fields in which the invention would be of significant utility.

Embodiments disclosed herein disclose computer-implemented methods, systems and computer program products for solving systems of linear inequalities that are used in air traffic analysis and control. Air traffic analysis of the airspace of the United States, for example, involves considering the movements of thousands of aircraft and their interactions with other aircraft that may be in the air at any given time. However, the methods, systems and computer program products for solving systems of linear inequalities that are disclosed herein are not limited to air traffic analysis, and may be applied to many other practical real-world problems and tasks in which optimization of multiple constraints and/or objectives is desired. As used herein, the term "linear inequalities" should be interpreted to include linear inequalities and equalities.

Linear inequalities can be generated for the formulation of many applications of optimization techniques, such as, but not limited to, air traffic control, transportation problems, and economic decision making. However, finding a feasible solution satisfying a set of linear constraints with a large number of variables is challenging. The lack of a systematic approach in dealing with high dimensionality, degree of freedom, and conflicting constraints, contributes to the challenge.

An embodiment of the present invention is an airspace analyzer for analyzing the airspace of the CONUS by simulating automatic air traffic control. The airspace analyzer utilizes a homogeneous system of linear inequalities to resolve potential conflicts and spacing violations for large number of flights scheduled to fly over a given airspace during peak hours. Both a feasible and optimal solution for a specific airspace analysis scenario may be formulated as a set of linear constraints and solved with linear programming techniques. For a busy airspace during peak periods with hundreds or thousands of aircraft, the constraint matrix may have hundreds of thousands of variables and over a million constraint inequalities. Embodiments described herein identify a feasible and/or an optimal solution for such an airspace analysis scenario using a linear inequalities solver and procedures that can remove infeasibilities of any given constraint inequality.

Embodiments described herein introduce new techniques that recursively remove both the maximum infeasibility and the sum of infeasibility for all the constraints of a homogeneous system of linear inequalities. The embodiments described herein are different from, and supplement or improve performance over, conventional methods such as the Simplex method and other existing techniques used by Cplex, LINDO, or GNU lpsolver etc. for solving linear programs.

Three key observations for linear equalities for applications such as air traffic analysis are noted. First, linear inequalities derived from operations research (OR) and applications in optimization typically have very large number of constraints and variables. Second, the constraint matrices may be sparse, singular, and ill-conditioned, namely a mix of very large and very small numbers. Third, there does not appear to be a conventional technique such as the Gaussian elimination or matrix inversion for the linear equalities to efficiently find the solution of a large system of linear inequalities as these. Linear inequalities are typically used as constraints limiting the feasible range for a given objective function. The conventional Simplex method is an example of using linear inequalities to obtain optimal value of a linear objective function. Embodiments disclosed herein include methods, systems and computer program products to locate optimal or feasible solutions of a large system of linear inequalities, such as the large, sparse and often ill-conditioned linear programs that are formulated in an air traffic analyzer.

Figure 3A:
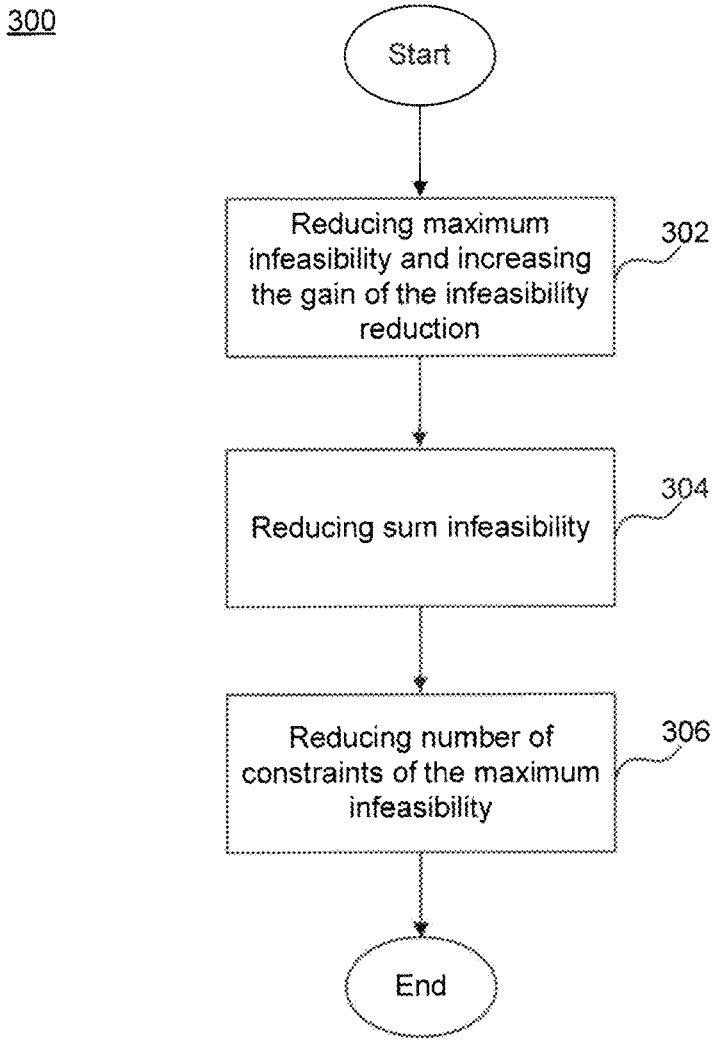
FIG. 3A is a flowchart of a method for resolving a homogeneous system of linear inequalities, according to an embodiment of the present invention.
Figure 3B:
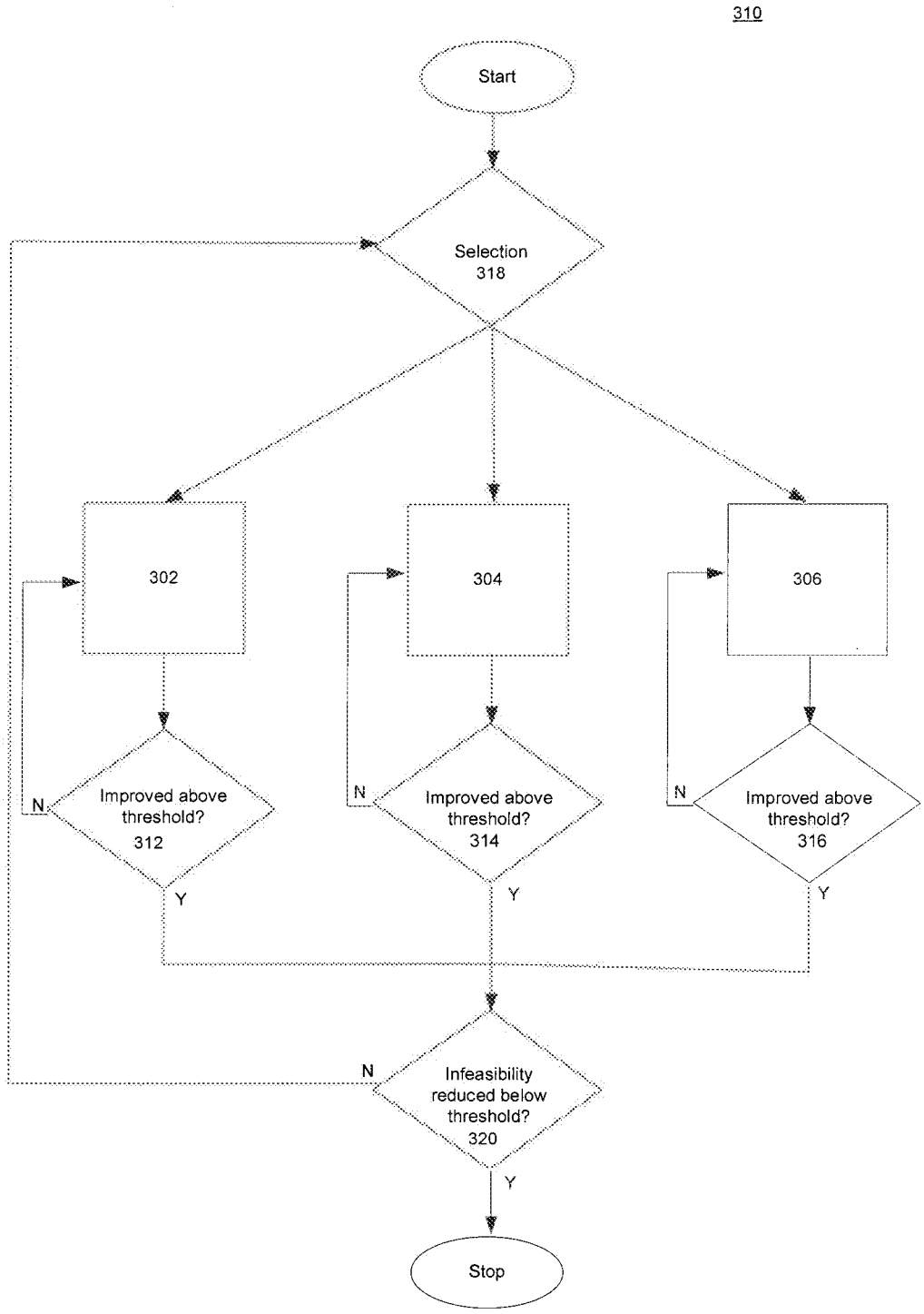
FIG. 3B is a flowchart of another method for resolving a homogeneous system of linear inequalities, according to an embodiment of the present invention.

According to an embodiment, linear infeasibilities are removed recursively with several techniques: applying a method to reduce the maximum infeasibility accompanied by a method for increasing the gain of each maximum infeasibility reduction (e.g., 302 in FIGS. 3A and 3B), locating zero-crossing points to reduce the sum of all infeasibility (e.g., 304 in FIGS. 3A and 3B), and performing a de-grouping technique to reduce the number of constraints with the maximum infeasibility (e.g., 306 in FIGS. 3A and 3B). In the embodiments described herein, the above noted techniques are applied to air traffic analysis. A person of ordinary skill in the art, given the teachings in this disclosure, would appreciate that the teachings herein can be applied to any other application that can be formulated as a system of linear constraints with or without an objective function.

According to an embodiment, the system of linear inequalities of the aircraft analyzer can be formulated as a linear program. In a primal linear program, the objective function can be represented as a linear combination of n variables. Typically, the primal linear program includes m constraints, each of which represents an upper bound on a linear combination of the n variables. The goal is to maximize the value of the objective function subject to the constraints. A "solution" to the linear program is a vector or list of n values that achieves the maximum value for the objective function.

In the corresponding dual linear program, the objective function is formulated as a linear combination of the m values that are the limits that are applicable to the m constraints from the primal linear program. In this formulation, there may be n constraints of the dual, each of which places a lower bound on a linear combination of m variables of the dual.

In a primal linear program, from each sub-optimal solution point that satisfies all the linear constraints, there can be one or more directions in which to move the solution point that increases (e.g. improves the optimality) the objective function. The moving of the solution point to improve it is performed by changing the values of the variables in the linear program. Variable values may be changed such that the difference between the candidate solution and one or more constraints is reduced. An "infeasible" value of the candidate solution is one that exceeds one or more of the constraints.

In the corresponding dual linear program, the dual vector multiplies the constants that determine the positions of the constraints in the primal. The dual vector can be minimized in order to remove the difference between the candidate positions of the constraints and the actual optimum. An infeasible value of the dual vector is one that is too low. A dual vector with an infeasible value sets the candidate positions of one or more of the constraints in a position that excludes the actual optimum.

According to an embodiment of the present invention, no distinction is required between the primal linear program and its dual. Instead, both the primal and the dual linear programs are combined in embodiments into a single linear program in self-dual form that includes the objective functions of both the primal and dual linear programs. Such a linear program is referred to as a homogeneous self-dual linear program. Specifically, in the homogeneous self-dual linear program formulation used in embodiments of the present invention, the duality gap of the linear program may be considered as the objective function. Hence, in embodiments of the present invention, the optimality for the linear program occurs at the zero duality gap as formulated in the homogeneous self-dual form of the linear program. The dual linear program in a self-dual linear program formulation is the same as the primal linear program, and the feasibility of a self-dual linear program represents optimality. Thus, the homogeneous self-dual linear program formulation greatly simplifies the linear program formulation for applications, such as air traffic analysis, and can focus the effort to find the optimal solution by removing all the infeasibilities.

FIG. 1 illustrates a flowchart of a method 100 using a homogeneous system of linear constraints to perform air traffic analysis, according to an embodiment of the present invention. Steps 102-108 of method 100 can be used, for example, to analyze the air traffic of all or part of the CONUS at any time of day in order to efficiently simulate air traffic control. In another embodiment, steps 102-108 can be used to determine control maneuvers and the like that can be implemented by aircraft to resolve any potential conflicts. For example, steps 102-108 may implement a simulation of an aircraft scenario by which control maneuvers for one or more aircraft are determined.

In step 102, information describing the aircraft positions and movements as well as information regarding airspace restrictions are input to the system. The information regarding the aircraft (referred to as "aircraft traffic information") can include, but is not limited to, the current location of each aircraft in the air, and flight plan information such as the intended destination for each aircraft, the intended flight path for each aircraft, and travel speed for each aircraft. Other information, such as the type of aircraft, maneuvering and/or operational restrictions of the particular type of aircraft, may also be included as information regarding the aircraft. The information that is entered to the system describing the aircraft and their movements can substantially describe the aircraft's current location and movements over a determined period of time in the future.

Airspace information (also referred to as "airspace sector information") can also be entered in step 102. Airspace information can include information, such as, sector boundaries, and various sector restrictions such as restrictions on areas for entry/exit to/from the respective sectors, altitude restrictions in the respective sectors, restrictions on distance between aircraft, restrictions on separation in trail of aircraft, and also any restrictions as to the types of aircraft that are permitted in the respective sectors. The aircraft information and airspace sector information can be entered to the system as linear constraints and linear objectives to yield a linear program. As noted above, there may be thousands of aircraft concurrently in the airspace of the CONUS. Representing such a large number of aircraft and other constraints in a linear program yields a linear programming system having several thousands of linear inequalities.

In step 104, the aircraft traffic information and airspace sector information obtained in step 102 are used to configure a homogeneous system of linear inequalities which is referred to herein as a linear inequalities solver (LIS). According to an embodiment, the aircraft traffic information and airspace sector information are configured as a homogeneous self-dual linear program. As described above, the configuration of linear constraints and linear objectives in the form of a homogeneous self-dual linear program enable the scalable and efficient resolution of large linear programming systems such as the linear programming systems that are applicable to air traffic analysis of the CONUS airspace.

A "self-dual" linear program is a linear program that combines a primal linear program and a corresponding dual linear program. The combined linear program (i.e. the self-dual linear program) may be of a higher dimensional linear space that includes both the primal and dual variables, such that the dual of the combined linear program is itself. However, such a self-dual linear program may still have an objective function and nonzero right-hand side. For example, a self-dual linear program may be non-homogeneous and may have an objective function to maximize or minimize. According to an embodiment, the combined linear program is configured such that the right-hand size is always zero and the feasibility can be measured by determining whether or not a given linear inequality is satisfied or violated. The objective function may be formulated as a pair of linear constraints such that the linear program comprises linear constraints only and does not have an objective function. A self-dual linear program that has been configured by representing the goals to maximize or minimize into inequalities is referred to as a homogeneous self-dual linear program. For example, because the objective function of such a linear program evaluates to zero, the objective function may be represented by a pair of linear inequalities $cx-by\geq 0$ and $-cx+by\geq 0$, where x and y are variables and c and b are constants. Such a homogeneous self-dual linear program is an LIS. In order to convert any given linear program to its LIS form, the dimensionality of the variables is increased to include both the primal and the dual, and the right hand side of every constraint inequality. For example, the primal linear program has m variables, the dual linear program has n variables, the self-dual linear program will have m+n variables, while the homogeneous self-dual linear program, which is simply an LIS of the linear program, has m+n+1 variables with the last variable fixed at value as 1.

In many applications, linear programs are formulated as a pair of primal and dual programs as shown in the following examples:

$$\text{The primal linear program: } \mathrm{Max}\{cx \mid Ax\leq b; l\leq x\leq u\} \tag{1}$$

$$\text{The dual linear program: } \mathrm{Min}\{by \mid yA=c;\ 0\leq y\} \tag{2}$$

l and u represent a lower and an upper bound for x, respectively. In embodiments of the present invention, in addition to (1) and (2) above, the zero duality gap for optimality, i.e. cx=by, is added yielding the following homogeneous self-dual formulation:

$$\begin{vmatrix} 0 & -A & b \\ A^T & 0 & -c \\ -b & c & 0 \\ b & -c & 0 \\ I & 0 & 0 \\ 0 & I & -l \\ 0 & -I & u \end{vmatrix} \cdot \begin{bmatrix} y \\ x \\ 1 \end{bmatrix} = S\cdot t = f \geq 0 \tag{3}$$

I is the identity matrix. Note that the square matrix $$\begin{bmatrix} 0 & -A & b \\ A^T & 0 & -c \\ -b & c & 0 \end{bmatrix}$$

is skew-symmetric, its dual is identical to the primal; hence, this is a self-dual formulation with objective function (0=cx−by). Because the objective function has a zero value, in formulating the linear program to be solved, the objective function can be treated as a pair of constraints as shown above. It should be noted that (1)-(3) shown above, and other equations illustrated below, are only exemplary, and illustrate the form of the linear relationships that are configured in embodiments of the present invention.

In step 106, the homogeneous self-dual linear program is solved by LIS. According to an embodiment, the homogeneous self-dual linear program configured in step 104 is solved to determine aircraft information (e.g. location etc.) and sector information (e.g. complexity of respective sectors etc.) at the expiration of a predefined time interval. Specifically, according to an embodiment, solutions for the homogeneous self-dual linear program may be obtained that represent aircraft horizontal and vertical positions at particular future times, and sector information at those times. The determined solution or series of solutions may be such that all the constraints are satisfied. Furthermore, the solution or series of solutions may be such that the constraints are satisfied in an optimal manner. According to an embodiment, for the linear program that is in homogeneous self-dual form, the resolution strategy is to locate the solution vector $$t = \begin{bmatrix} y \\ x \\ 1 \end{bmatrix}$$

that satisfies $S \cdot t = f \geq 0$.

The column vector, f, represents the feasibility of each row as a constraint inequality. Hence, f may be considered as the feasibility vector for the given system of linear inequalities.

According to an embodiment, the goal of solving both the primal and its dual linear programs is to locate the solution t for S such that f does not have any infeasible rows. A row corresponds to a constraint. The resolution of the homogeneous LIS, according to an embodiment, yields a second set of aircraft information and a second set of airspace sector information. The second set of aircraft information can, for example, represent aircraft locations and movements at the expiration of a predetermined interval of time. The second set of airspace sector information can include, for example, sector related information such as aircraft future positions within the respective sectors and the complexity of the respective sectors at the expiration of the predetermined interval of time. The complexity of the sectors may be represented by metrics determining the degree to which air traffic control goals (e.g. all the aircraft separated properly; do they exit their sector according to air traffic control procedures, etc.) are satisfied. The resolution of the homogeneous self-dual linear program is further described in relation to FIG. 3 below.

In step 108, the information obtained by solving the homogeneous LIS is conveyed to the user via a display or other means. For example, the locations of the aircraft and their movements may be animated or displayed on a screen representing a projected view of the airspace at a future point in time at the expiration of a predetermined time interval. According to an embodiment, the ability to achieve air traffic control goals is represented by metrics based on factors, such as, but not limited to, the number of aircraft in the sector, the number of aircraft maneuvers required in the sector, the separation distance among aircraft in the sector, and the like.

Figure 2A:
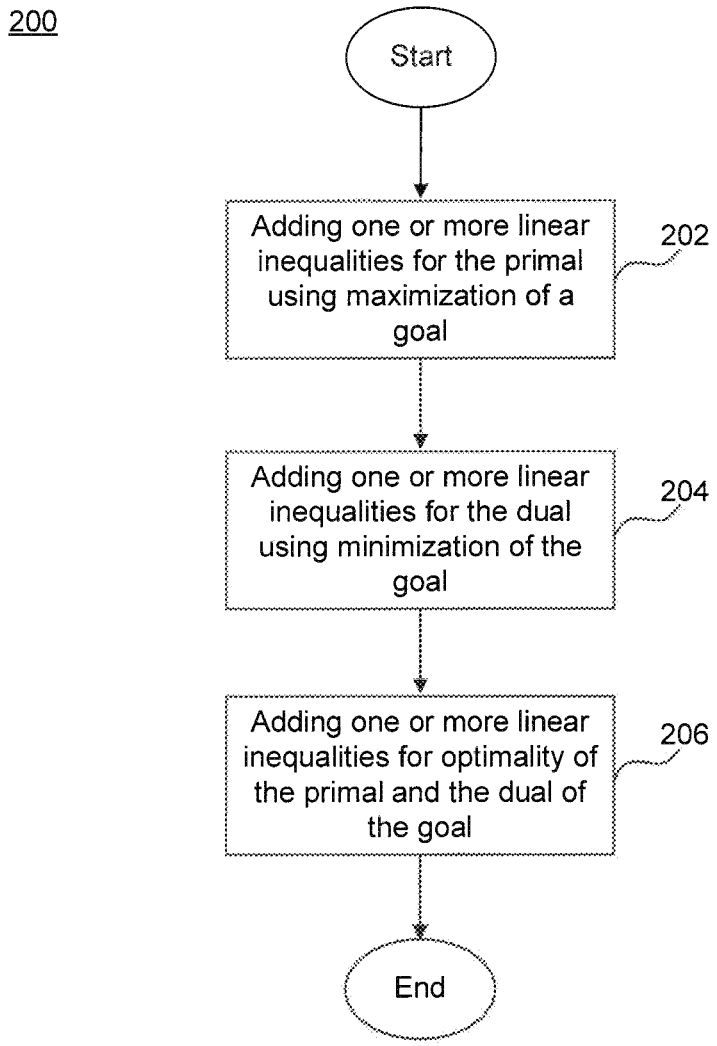
FIG. 2A is a flowchart of a method for configuring a self-dual linear program, according to an embodiment of the present invention.

FIG. 2A illustrates a method 200 for configuring a homogeneous self-dual linear program, according to an embodiment of the present invention. For example, method 200 can be used in performing step 104 of method 100 described above. In step 202, a linear program is configured for the primal. According to an embodiment, a linear program formulated to maximize a goal, such as that shown in (1) above, is configured. Linear equalities and inequalities that, for example, correspond to aircraft movements and sector restrictions, may be configured as a primal linear program in the form of (1) above.

FIG. 2B illustrates a portion of an example configuration of a linear program for air traffic analysis and control according to an embodiment of the present invention. The example configuration illustrates a two aircraft scenario in which the position (e.g., Cartesian position (x, y, z)) of the first aircraft is represented by variables (xa30_1, ya30_1, za30_1) and the position of the second aircraft is represented by (xa30_2, ya30_2, za30_2). The objective function 212 seeks to maximize the sum positions of both aircraft while imposing a penalty if separation requirements indicated by dSepP_1_2, dSepL_1_2, and dSepZ_1_2 are exceeded. Illustrated constraints 214 represent various horizontal and vertical speed constraints and separation distance constraints. 216 illustrates that the x, y positions of the aircraft are free variables.

Returning to FIG. 2A, in step 204, a linear program for the dual of the previously entered primal is configured. In the dual linear program, the dual vector is configured to multiply the constants that determine the positions of the constraints in the corresponding primal. According to an embodiment, the dual linear program may be configured by varying the dual vector, which is equivalent to revising the upper bounds in the primal problem. In configuring the dual vector, the lowest upper bound may be sought. For example, the dual vector may be minimized in order to reduce the slack between the candidate positions of the constraints and the actual optimum. As described above, an infeasible value of the dual vector is one that is too low. It sets the candidate positions of one or more of the constraints in a position that excludes the actual optimum. According to an embodiment, the dual may include the minimization of a dual of the goal function, as illustrated in (2) above.

In step 206, a linear program for the homogeneous self-dual formulation of the primal and the corresponding dual is configured. According to an embodiment, a homogeneous self-dual formulation as illustrated in (3) above and corresponding to the configured primal and dual may be used. Specifically, in addition to the primal and dual formulations, a formulation setting the goal equal to the dual of that goal is configured in the system of linear inequalities.

FIG. 3A illustrates a method 300 for solving a homogeneous self-dual formulation of a linear program or other linear inequalities. According to an embodiment, method 300 can be used to perform step 106 of method 100 described above. In method 300, one or more of three techniques may be employed to solve the homogeneous self-dual linear program configured, for example, using method 200.

In conventional systems for solving linear programs using the Simplex method, an initial solution is obtained with a full rank basis matrix and adjustment to the solution is obtained by the swapping of basis variables by selected columns and rows. For very large systems with tens of thousands of rows and columns, the inversion of a full rank nonsingular matrix becomes very processor intensive. In embodiments of the present invention, a different strategy that deals with the maximum infeasible rows (negative fhd i) is used to find adjustment to the current solution to the linear program. For the recursive reduction of the sum of all infeasible rows, a zero-crossing strategy is used to remove or add variables. The number of rows in the linear program with the maximum infeasibility may be reduced with the technique of zero-crossing or a de-grouping strategy that allows selected rows to reduce their respective infeasibilities. Furthermore, a de-blocking strategy may be used to reduce the maximum infeasibility by increasing the gain of the reduction in the infeasibility. A de-blocking strategy is to increase the gain of infeasibility reduction for all the constraints with the maximum infeasibility. De-blocking may be achieved with the adjustment of specific column variable or variables that causing the blocking of maximum infeasibility reduction. These three techniques are further described below.

In step 302, the maximum infeasibility of the linear program is reduced. Infeasibilities, as described above, are constraints that cannot satisfy the candidate solution to the linear program. Specifically, when a linear constraint (e.g., row) is posed as a linear inequality, such as $ax \geq b$ (e.g., a dot-product bounded by a constant), the variables, x (a vector x with n values) is feasible if the linear constraint is satisfied; otherwise, x is said to be infeasible. The amount of infeasibility is the measure of how much the feasibility requirement is violated. In other words, the feasibility f may be defined as $f=Ax-b$. Note that, accordingly, f is a vector, and that the $i^{th}$ component of vector f is by definition, the feasibility of the $i^{th}$ constraint (row). According to an embodiment of the present invention, all available nonzero coefficients in A may be used to achieve feasibility for all rows.

The homogeneous self-dual form (3) may be considered as represented by a rectangular m by n matrix, S, where m is the number of rows as constraints while n is the number of columns for both the primal and dual variables x and y plus one for the last column to enforce homogeneity. The vector, f, in (3) is a measure of feasibility for each row as a constraint inequality. Rows of the matrix can be rearranged by sorting the feasibility vector, f, such that the values for f are in descending order as follows:

$$f_{\downarrow} = P*S*t = P*f = \begin{bmatrix} f_p(>0) \\ f_z(=0) \\ f_n(<0) \\ f_{-\infty}(\text{Min}) \end{bmatrix} = \begin{bmatrix} S_p \\ S_z \\ S_n \\ S_{-\infty} \end{bmatrix} * t \tag{4}$$

P is a permutation matrix that rearranges the rows of S according to $f_{\downarrow}$. $f_{\downarrow}$ represents f as a vector sorted in descending order. $f_{-\infty}$ represents the smallest component of vector f. $S_{-\infty}$ represents rows in S with indexes corresponding to $f_{-\infty}$.

The technique to reduce the maximum infeasibility of the linear program in this step applies to all the rows in $S_{-\infty}$. Consider, $S_r$, the basis of $S_{-\infty}$. $S_r$ has the same row rank as that of $S_{-\infty}$. Similar to the Simplex method, a small adjustment, $\Delta t$ to the tentative solution, t, is computed from the full rank basis for all the rows in $S_{-\infty}$. The rows in $S_{-\infty}$ are decomposed into groups $S_r$ and $S_d$, such that $$S_{-\infty} = \begin{bmatrix} S_d \\ S_r \end{bmatrix}.$$

$S_r$ consists of all linearly independent rows, and rank of $S_r$, $\text{rank}(S_r)=r$=number of rows in $S_r$. The rest of the rows in $S_{-\infty}$ (i.e., all rows that are dependent on some row in $S_r$) are included in $S_d$. Since the rows in $S_r$ will have n columns with $r \leq n$, those columns can be organized into two parts as B and N such that B is a square r×r sub matrix. Thus, B is a nonsingular square submatrix of $S_r$ such that $S_r=[B,N]$. N represents columns of $S_r$ that are not in basis B. The maximum allowable adjustment to t can be determined as $\Delta t$ as follows: $t_0=0$, $t_{k+1}=t_k+\Delta t_k$ while $\Delta t_k=\mu|f_{-\infty}|B^{-1}\cdot 1$ with $$\mu=\min_{\forall s_i \in S-S_{-\infty}}\{(f_i-f_{-\infty})/|f_{-\infty}|(1-B^{-1}*1_r\cdot s_i)\}, \text{ where } S^T=\{s_i\}_{i-1}^{m} \tag{5}$$

Figure 4:
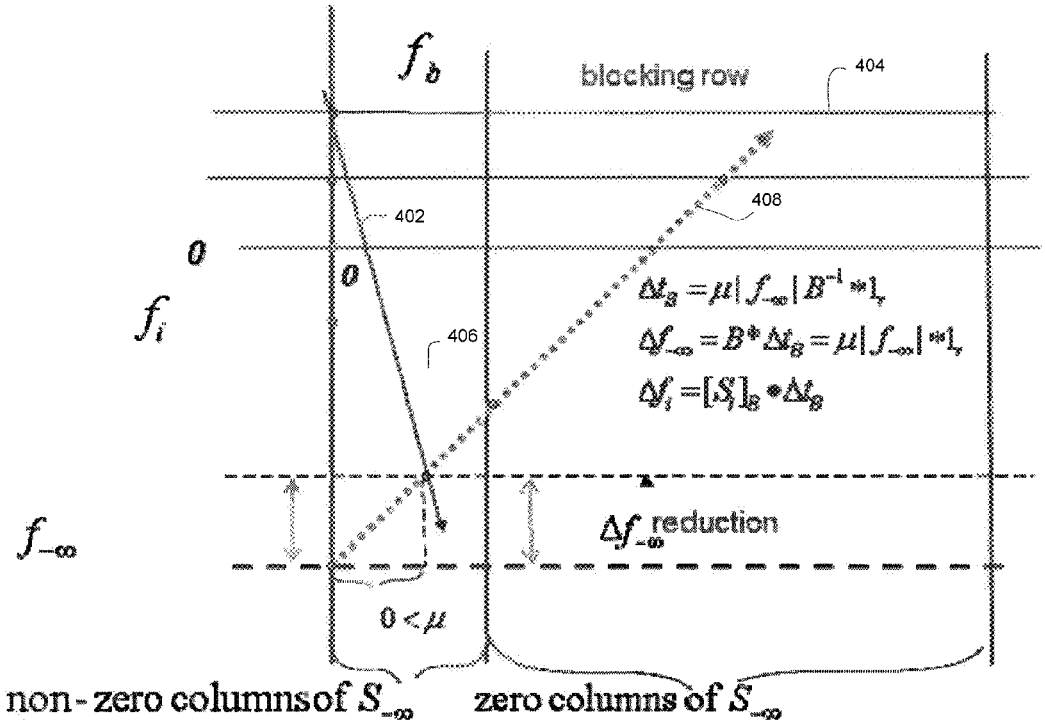
FIG. 4 is a graphical illustration of how a technique to reduce the maximum infeasibility is used to reduce the worst case feasibility violations, according to an embodiment of the present invention.

FIG. 4 graphically illustrates the reduction of $|f_{-\infty}|$ by the technique for reducing the maximum infeasibility (referred to as algorithm A1). Specifically, algorithm A1 is used to reduce the maximum infeasibility by increasing the gain of the maximum infeasibility reduction.

FIG. 3B illustrates another method (310) for solving a homogeneous self-dual formulation of a linear program or other system of linear inequalities. According to an embodiment, method 310 can be used to perform step 106 of method 100 described above. In method 310, one or more of three techniques may be employed to solve the homogeneous self-dual linear program configured, for example, using method 200.

In step 318, a selection is made which of the infeasibility improvements 302, 304, and 306 are to be invoked next. The details of infeasibility improvements 302, 304, and 306 were described above. According to an embodiment, in step 318, infeasibility improvements 302, 304, and 306 are invoked in that order. However, they may be invoked according to another order, for example, reducing maximum infeasibility in 302 followed by reducing the number of maximum infeasible rows 306, followed by more 302, and then reducing the sum infeasibility 304. Infeasibility improvements 302, 304, and 306 may be invoked repeatedly.

Following the selection, one of 302, 304, or 306 is invoked. If 302 is invoked, 302 may be iteratively invoked until, as shown in 312, the reduction in the maximum infeasibility is found to be less than a predetermined threshold. If 304 is invoked, 304 may be iteratively invoked until, as shown in 314, the reduction in the sum infeasibility is found to be less than a predetermined threshold. If 306 is invoked, 306 may be iteratively invoked until, as shown in 316, the reduction of the number of rows with maximum infeasibility is found to be less than a predetermined threshold.

Following the iterative invocation of either 302, 304, or 306, at step 320, it is determined whether the infeasibility is reduced below a predetermined threshold. If not, processing continues by selecting a next invocation at step 318. If the infeasibility is reduced below the predetermined threshold, method 310 terminates.

FIG. 4 is a graphical illustration of how the technique to reduce the maximum infeasibility is used to reduce the worst case feasibility violation for the set of rows with the same $f_i$ where f is the sorted feasibility vector ($f_i$ is the $i^{th}$ component of the feasibility vector f).

All rows that have a maximum feasibility violation $f_i(<0)$ are adjusted with an adjustment vector $\Delta t$ to the latest solution, t, such that all $f_i$ for this set are improved simultaneously with a positive $\Delta f_i$. The maximum possible infeasibility reduction $\Delta f_i$ is determined by one or more rows with its $f_i$ (feasibility) above the worst case feasibility. The maximum amount of $\Delta f_i$ that can be achieved for a given call to the technique to reduce the maximum infeasibility (e.g., algorithm A1), is determined by one or more rows, namely, the blocking row or rows, with the same adjustment vector $\Delta t$.

In FIG. 4, the arrow 402 is graphical illustration of the effect to a row that is not in $f_{-\infty}$ (with $f_j > f_{-\infty}$ for some j not in $S_r$). As all rows are adjusted based upon the columns in B, as the dot product $[S_j]_B \cdot \Delta t_B$ ($=\Delta f_j$), such an adjustment is different to the adjustment for all the rows in $f_{-\infty}$ ($=\Delta f_{-\infty}=B*\Delta t_B$). Note that $\Delta t_B$ has non zero values only for columns in B, and the rest of variables for columns in N are zeros.

The dotted arrow 406 illustrates the change in $f_i$ for any row i not in $S_{-\infty}$. The dotted arrow 408 illustrates changes in $f_{-\infty}$ as $\Delta f_{-\infty}$. Among all possible f, for any row i not in $f_{-\infty}$, there is one (or more) rows with its $\Delta f_i$ will intercept $\Delta f_{-\infty}$ at the lowest point; such a row 404 is identified as the blocking row. The solid arrow 402 is used to identify the blocking row such that the reduction in $|f_{-\infty}|$ cannot exceed $\mu|f_{-\infty}|$. FIG. 4 illustrates the fact that improvement in $f_{-\infty}$ may reach a point where group benefit for $f_{-\infty}$ is no longer useful as the feasibility of the blocking row ($f_b(=f_{road_block})$ will fall below the $f_{-\infty}$). The top most horizontal line 404 is the current value of $f_b$ before algorithm A1 is applied. All horizontal lines are where feasibility values (f) are before and after algorithm A1 is applied as $S_i \cdot \Delta t_B$ for any row i.

According to an embodiment, the reduction of the maximum infeasibility by increasing the gain of the reduction can be accomplished in several steps, beginning with determining the set $S_{-\infty}$ of all rows with the worst infeasibility. Thereafter, the set $\vec{C}_{-\infty}$ of columns that are not reachable from any rows in $S_{-\infty}$ is determined. For each column $c_y$ in $\vec{C}_{-\infty}$ the set $R_{c_y}$ of rows that are not in $S_{-\infty}$ is determined. Thereafter, identify the blocking row $r_b$ for all the rows in $R_{c_y}$. Based upon the above steps, the infeasibility of each blocking row is reduced by the nonzero coefficient $c_{r_b c_y}$ at row $r_b$ in column $c_y$.

Figure 5:
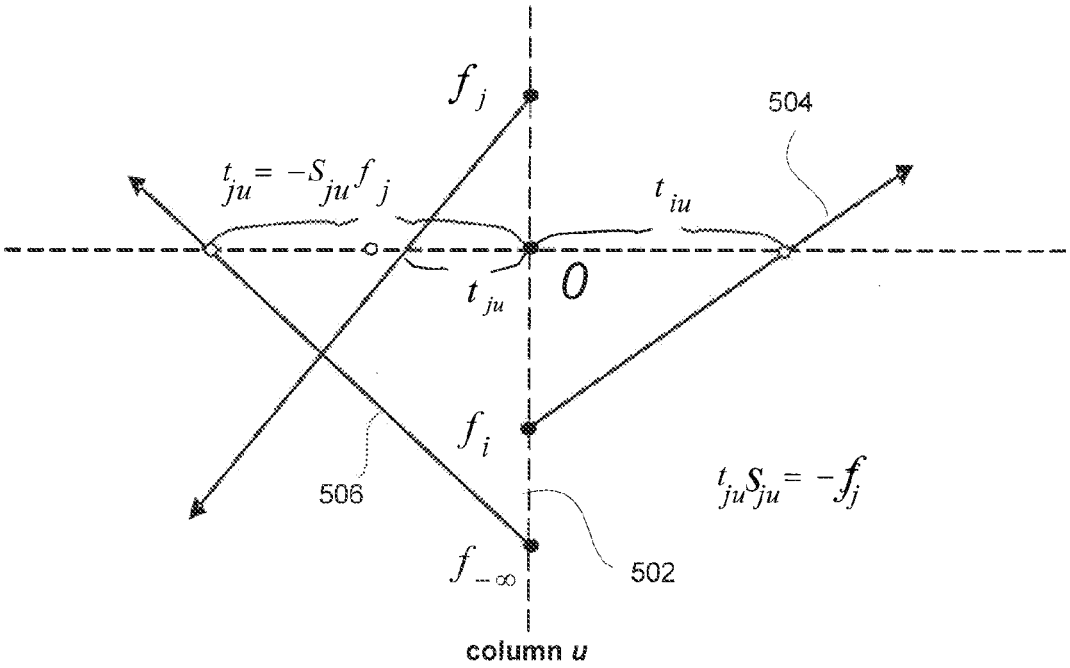
FIG. 5 is a graphical illustration of the reduction of a sum of all infeasibility, according to an embodiment of the present invention.

Returning to FIG. 3, in step 304, the sum infeasibility of the linear program is reduced. According to an embodiment, a technique to reduce the sum infeasibility of a linear program, such as that shown in (3) above, is applied. The above technique to reduce the maximum infeasibility works very well if the size of $S_{-\infty}$ is small. Applying that technique, however, the following two problems may be encountered. First, the size of $S_{-\infty}$ increases monotonically. Second, all the rows in $S_{-\infty}$ may not be totally linearly independent and the selection of basis B is not unique. To overcome these two problems, we design the technique to recursively reduce the sum of infeasibility (also recursively reduce the number of infeasible rows) of and/or the maximum infeasibility ($S_{-\infty}$). For an infeasible row (such as row i) to become feasible, one must move the feasibility $f_i$ through the nonzero columns of $S_i$. Such nonzero columns of $S_i$ defines the set of all zero crossing for $f_i$. This technique identifies all the zero-crossing points for S and tests their impacts on both the sum and maximum infeasibility for S. This technique can also be applied recursively to reduce either the sum of all infeasibility of S or the size of $S_{-\infty}$. FIG. 5 illustrates the reduction of the sum of all infeasibility of S or the size of $S_{-\infty}$ or both.

FIG. 5 is a graphical illustration of the relation between a technique for reducing the sum infeasibility of the system of linear inequalities, and zero-crossing points for all infeasible rows. For an infeasible row, i.e., $f_i<0$, the only possible adjustments to remove its infeasibility (feasibility violation) are through the nonzero columns of that row. Hence, all zero crossing points for any infeasible row must be computed and tested to determine its impact over the sum and worst case feasibility violation. Among all possible zero-crossing points, the technique to reduce infeasibility can quantify the net gain or loss to both sum of feasibility violation for all rows, and the worst case feasibility violation, and the number of rows with the maximum feasibility violation.

Column u 502 represents any column u for $1 \le u \le (n-1)$ where n is the number of columns in S. The arrow 504 from column u 502 heading up and right illustrates the change that would happen to the feasibility value $f_i$ for row i. Namely, we have $\Delta$fhd $i=t_{iu}S_{iu}$ (in this example, we have a positive $S_{iu}$ which is simply the nonzero coefficient of S at row i and column u).

Zero crossing points are where the feasibility of a specific row becomes zero. For those rows with fhd i>0, the arrow must point downward. Hence, a positive $S_{ju}$ will result in a negative $t_{ju}<0$. The arrow 506 that points up and left for column u shows that for rows in $f_{-\infty}$ which are <0, the likely reduction of infeasibility (i.e., improvement in $f_{-\infty}$) will be either a positive $S_{ju}>0$ with $\Delta t_u>0$, or a negative $S_{ju}<0$ with $\Delta t_u<0$.

The values $t_{iu}$ (or $t_{ju}$) are the amounts of adjustment to variable $t_u$ over column u needed for row i with $f_i \neq 0$ to reach $f_i=0$. Hence, we have $f_i(t+t_{iu}S_{iu})=f_i+t_{iu}S_{iu}=0$ (similarly, $f_j(t+t_{ju}S_{ju})=f_j+t_{ju}S_{ju}=0$).

$\Delta I=I_2-I_1$, where $$I_1 = \sum_{f_i<0} f_i,\ I_2 = \sum_{g_i<0} g_i,$$

$g_i=f_i+t_{ju}s_{ju}$, is the change in sum of all infeasible rows (with $f_i<0$) before and after a zero crossing operation (e.g., applying algorithm A2) is performed (the value of variable $t_u$ is adjusted by $t_{ju}S_{ju}$ (for column u). Note that zero-crossing may result in the reduction of $|f_{-\infty}|$ or the regrouping of $S_{-\infty}$.

Returning to FIG. 3, in step 306, de-grouping is applied to reduce the number of constraints that have the same worst case infeasibility. Specifically, a de-grouping technique is applied to reduce the set size of all the rows with $f_i=f_{-\infty}$.

De-blocking, as referred to in this disclosure, is a relation between local feasibility and global infeasibility. Specifically, in steps 302 and 304 described above the worst case infeasibilities over all (i.e. global) constraints are simultaneously considered for improvement, the de-blocking method of step 302 seeks to resolve conflicts between such global infeasibilities and local feasibility considerations which apply to a particular constraint. The blocking of the global infeasibility considerations typically are caused by the conflict between the global worst case infeasibility reduction effort and local linear constraints. De-blocking is performed in order to identify the nonzero linear coefficients that can prevent such global to local conflicts and allowing maximum possible gain in each application of the infeasibility methods described in relation to steps 302 and 304 above. The amount of computation effort for the de-blocking and de-grouping combined may be proportional to the total number of nonzero linear coefficients (NNZ) of the given system of linear inequalities.

Figure 6:
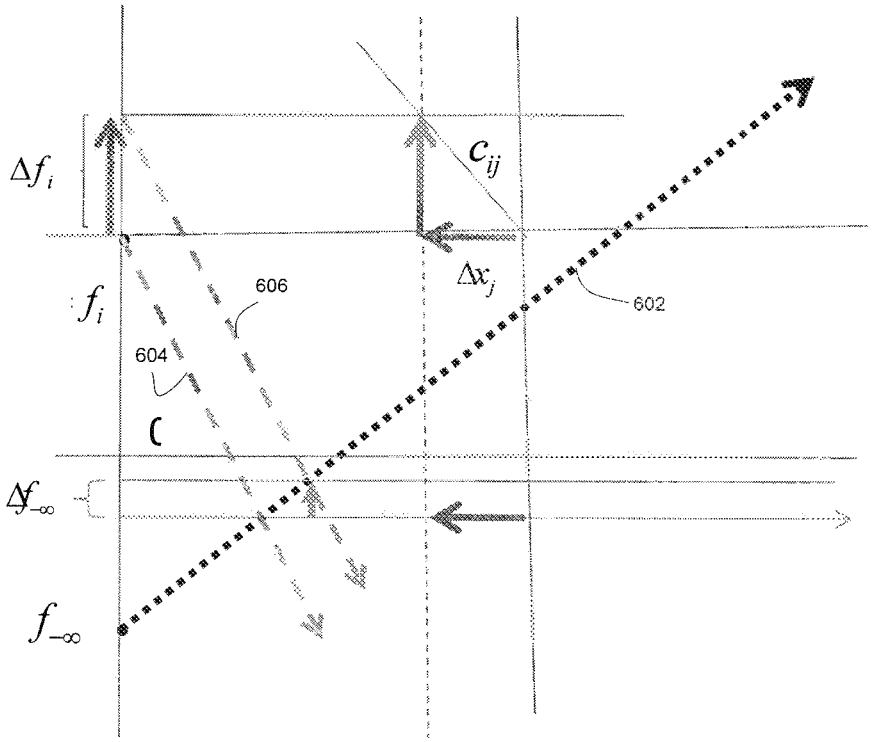
FIG. 6 is a graphical illustration of how a de-blocking technique is applied to a homogeneous system of linear inequalities, according to an embodiment of the present invention.

FIG. 6 illustrates the concept of linear infeasibility de-grouping and its impact on the techniques employed for reducing the maximum infeasibilities and the sum infeasibility. The reduction in global maximum infeasibility $f_{-\infty}$ is illustrated by vector 602. The blocking row $f_b$ before and after de-grouping is illustrated respectively by vectors 604 and 606.

Since the net reduction in the global maximum infeasibility, $f_{-\infty}$ illustrated by vector 602, is determined by the blocking row, $f_b$, as shown in FIG. 6, it may be observed that a de-grouping strategy is needed to move $f_b$ away from $f_{-\infty}$ if there are columns that increase the feasibility of the blocking row without penalizing $f_{-\infty}$. FIG. 6 illustrates how the gain $\Delta f_i$ for the row with the maximum feasibility violation (or the worst case infeasibility) computed by the technique for reducing the maximum infeasibilities (e.g., in algorithm A1 as described above) may be increased if the blocking row (or rows) has nonzero columns that have little or no impact over the rows with the maximum feasibility violation (MIF). De-grouping results in a reduction of size of $S_{-\infty}$.

According to an embodiment, the reduction of the maximum infeasibility by reducing the number of constraints that have the same worst case infeasibility can be accomplished in several steps beginning with determining the set $S_{-\infty}$ of all rows with the worst infeasibility. Thereafter, the set $C_{-\infty}$ of columns that are reachable from any rows in $S_{-\infty}$ is determined. For each column $c_x$ in $C_{-\infty}$ the set $R_{c_x}$ of rows that are reachable from $S_{-\infty}$ is determined. Then, it is checked if all rows in $R_{c_x}$ are of the same sign (positive or negative). If it has the same sign, then adjustments are made to variable of column $c_x$ to reduce the size of $S_{-\infty}$ by $R_{c_x}$.

Figure 7:
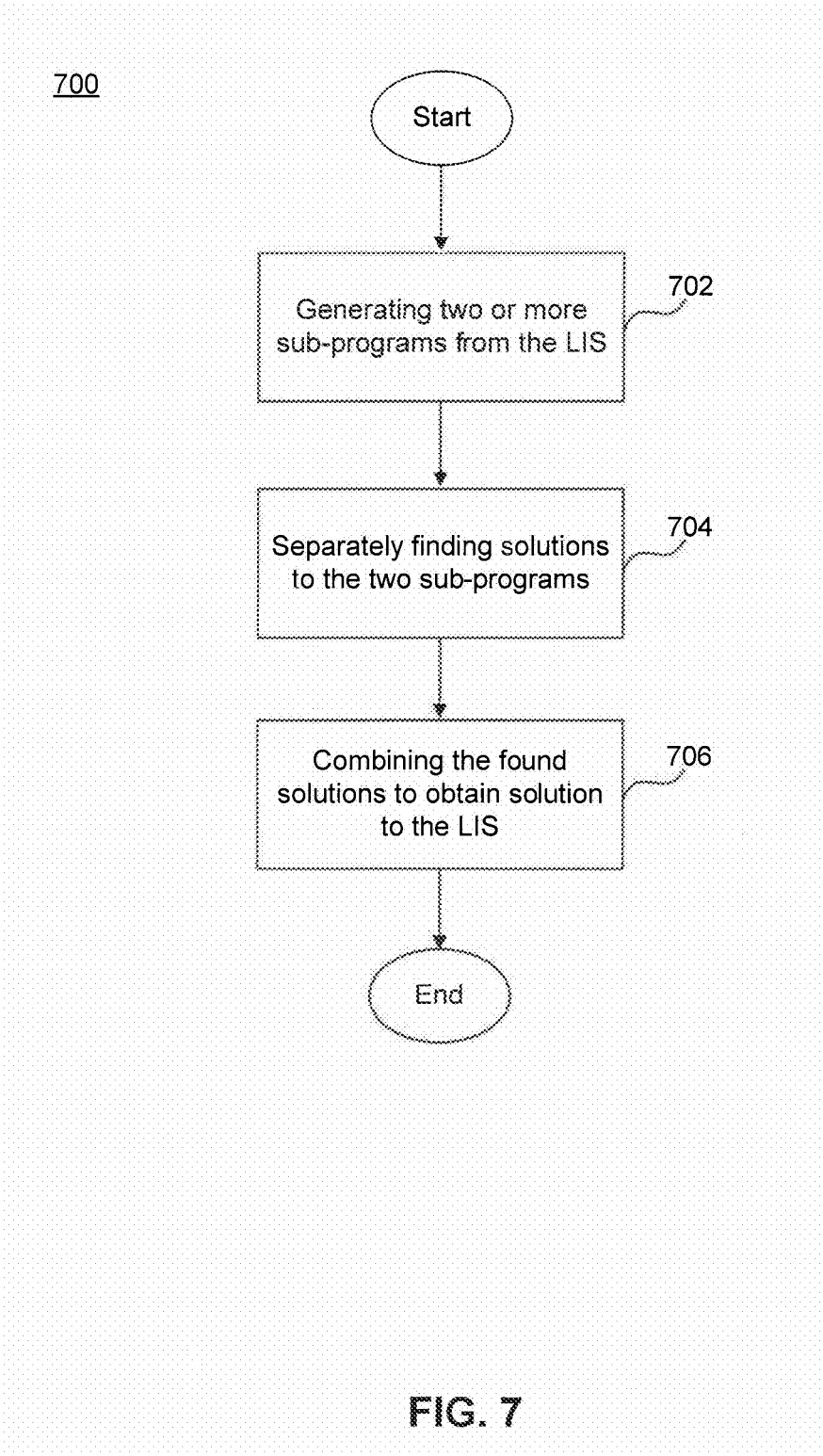
FIG. 7 is a flowchart illustrating a technique to resolve a homogeneous system of linear inequalities, according to an embodiment of the present invention.

FIG. 7 is a flowchart illustrating a method 700 to resolve a system of linear inequalities, according to an embodiment of the present invention. Specifically, method 700 is a technique to separately resolve parts of the linear program and to combine the solutions to those parts to obtain the solution to the combined linear program. Method 700 can be performed recursively.

In step 702, two or more sub-programs are generated from the linear program to be resolved. The generation of the plurality of linear programs from the one linear program may be based upon various criteria. According to an embodiment, the airspace of the CONUS can be divided to east and west sectors and linear programs may be separated for the east and the west geographical areas.

In step 704, the plurality of linear programs are resolved separately. For example, the airspace for the east and the west parts of the CONUS may be resolved separately in step 704. The linear programs for each part of the airspace may be resolved using methods such as methods 100-300 described above.

In step 706, the solutions obtained for the separate linear programs are combined to obtain the combined solution to the complete linear program. For example, the solutions separately obtained for the east airspace and the west airspace may be combined to obtain the solution for the CONUS airspace.

Figure 8:
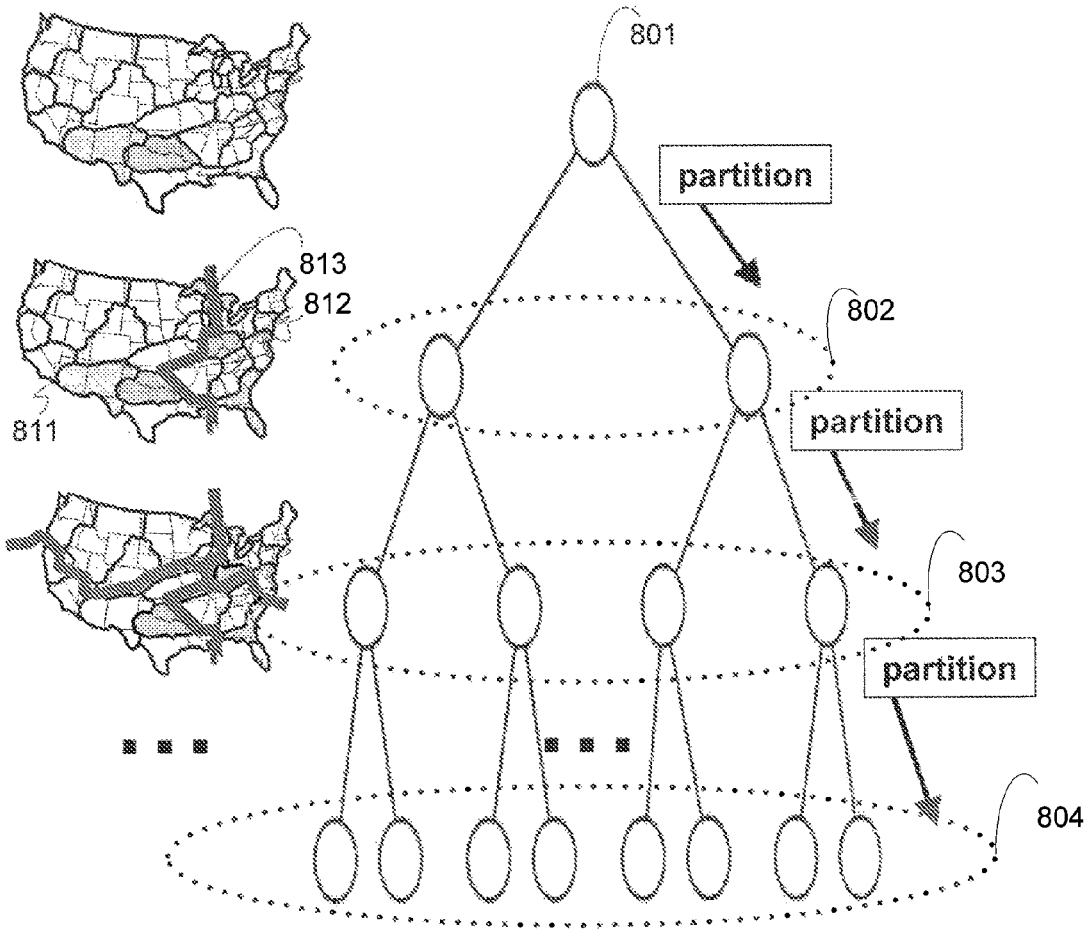
FIG. 8 is a graphical illustration of a method for recursively resolving a homogeneous system of linear inequalities, according to an embodiment of the present invention.

FIG. 8 graphically illustrates recursively partitioning the airspace of the CONUS to resolve the respective linear programs corresponding to each partition. For example, each trio of a parent node and its two child nodes in FIG. 8 correspond to an instance of the process of FIG. 7. The recursive resolution process may be viewed as a tree shown in FIG. 8. At 801, the linear program representing the entire CONUS is obtained. For example, the linear program at 801 includes linear inequalities for all the aircraft within the CONUS and inequalities representing all sectors in CONUS.

At 802, the linear program represented at 801 is represented as two separately resolvable linear programs. According to an embodiment, the linear program representing the entire CONUS at 801, may be divided at 802 to a linear program representing a western airspace 811 and eastern airspace 812 based upon a geographical separation 813. According to an embodiment, geographical separation 813 may be determined based upon first determining for the CONUS clusters of tightly interacting aircraft, and then determining a minimum cut-set based upon those determined clusters.

Similarly, method 700 may further divide each partition into one or more partitions, as shown in 803 . . . 804, into smaller partitions. This process may be recursively employed to until partitions of a predetermined size is obtained. According to an embodiment, the process is continued until partitions each partition includes only a single aircraft. At the smallest level of the partitions, the corresponding systems of linear equations are resolved to obtain multiple solutions. The multiple solutions corresponding to the node in the tree one level higher are then combined. Then, at the next higher layer in the tree, the corresponding combined solutions from the lower level combined. This recursive process efficiently yields a combined solution at 801, representing the CONUS. The ultimate solution to the CONUS was obtained by recursively partitioning the airspace partitions to smaller partitions, and then, starting from the smallest partitioning, combining the solutions from the lower level to obtain the solution of the next higher level.

Example System Embodiments

Figure 9:
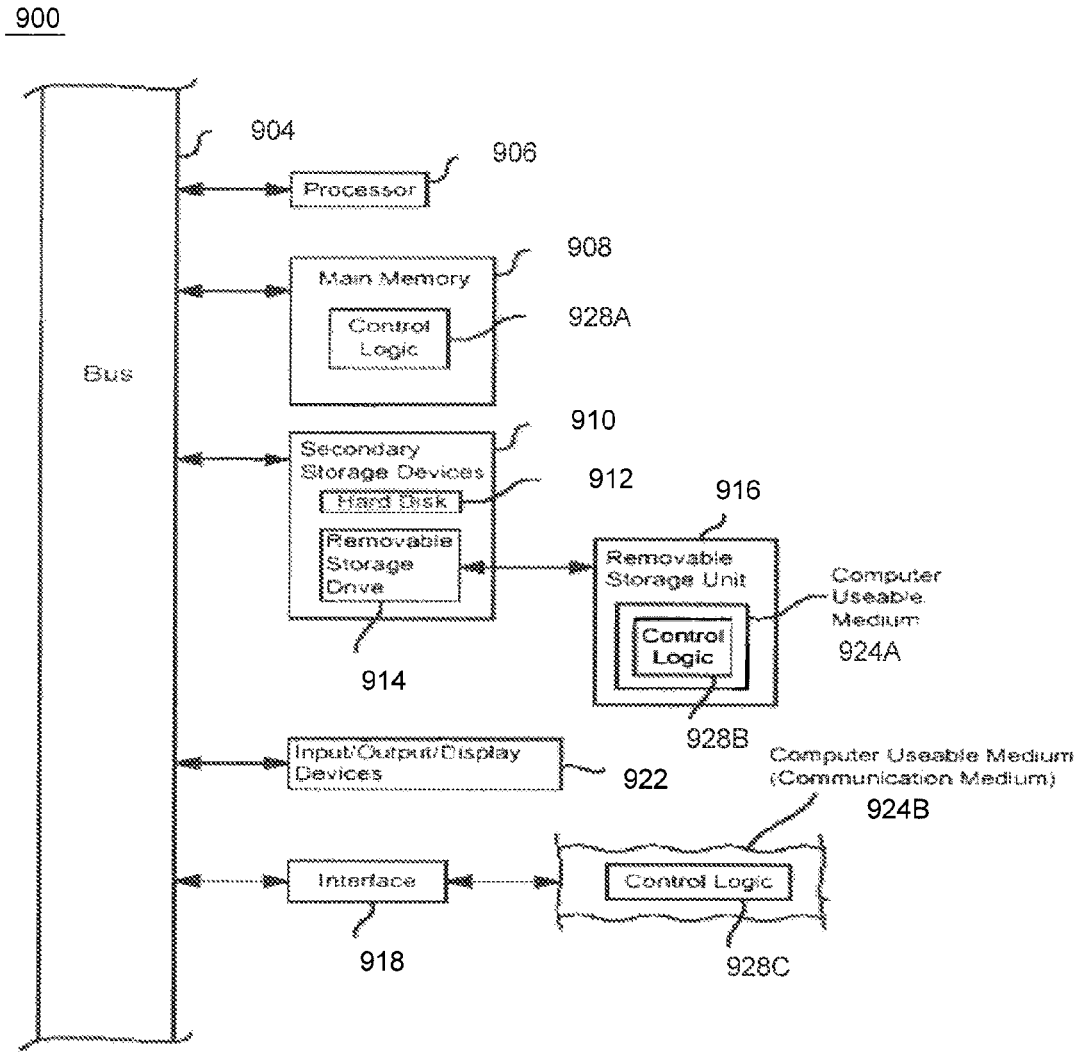
FIG. 9 is a computer system that can be configured for solving a homogeneous system of linear inequalities, according to an embodiment of the present invention.

In an embodiment of the present invention, the system and components of embodiments of the present invention described herein are implemented using well known computers, such as computer 900 shown in FIG. 9.

The computer 900 includes one or more processors (also called central processing units, or CPUs), such as a processor 906. The processor 906 is connected to a communication bus 904.

The computer 900 also includes a main or primary memory 908, such as random access memory (RAM). The primary memory 908 has stored therein control logic 928A (computer software), and data.

The computer 902 may also include one or more secondary storage devices 910. The secondary storage devices 910 include, for example, a hard disk drive 912 and/or a removable storage device or drive 914, as well as other types of storage devices, such as memory cards and memory sticks. The removable storage drive 914 represents a floppy disk drive, a magnetic tape drive, a compact disk drive, an optical storage device, tape backup, etc.

The removable storage drive 914 interacts with a removable storage unit 916. The removable storage unit 916 includes a computer useable or readable storage medium 924 having stored therein computer software 928B (control logic) and/or data. Removable storage unit 916 represents a floppy disk, magnetic tape, compact disk, DVD, optical storage disk, or any other computer data storage device. The removable storage drive 914 reads from and/or writes to the removable storage unit 916 in a well known manner.

The computer 902 may also include input/output/display devices 922, such as monitors, keyboards, pointing devices, etc.

The computer 902 further includes at least one communication or network interface 918. The communication or network interface 918 enables the computer 902 to communicate with remote devices. For example, the communication or network interface 918 allows the computer 902 to communicate over communication networks or mediums 924B (representing a form of a computer useable or readable medium), such as LANs, WANs, the Internet, etc. The communication or network interface 918 may interface with remote sites or networks via wired or wireless connections. The communication or network interface 918 may also enable the computer 902 to communicate with other devices on the same platform, using wired or wireless mechanisms.

Control logic 928C may be transmitted to and from the computer 902 via the communication medium 924B.

Any apparatus or manufacture comprising a computer useable or readable medium having control logic (software) stored therein is referred to herein as a computer program product or program storage device. This includes, but is not limited to, the computer 902, the main memory 908, secondary storage devices 910, and the removable storage unit 916. Such computer program products, having control logic stored therein that, when executed by one or more data processing devices, cause such data processing devices to operate as described herein, represent embodiments of the invention.

The invention can work with software, hardware, and/or operating system implementations other than those described herein. Any software, hardware, and operating system implementations suitable for performing the functions described herein can be used.

Conclusion

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A computer-implemented method for simulating aircraft traffic control using one or more processors comprising:

receiving as input, by the one or more processors, airspace sector information and aircraft traffic information, wherein the airspace sector information imposes a plurality of sector restrictions associated with an aircraft;

configuring, by the one or more processors, a homogeneous system of linear inequalities based upon the airspace sector information and aircraft traffic information;

resolving, by the one or more processors, the homogeneous system of linear inequalities to generate a second airspace sector information and a second aircraft traffic information, wherein the second airspace sector information and the second aircraft traffic information are based upon a predetermined future point of time, and the resolving including at least one of:

reducing, by the one or more processors, a maximum infeasibility of the homogeneous system of linear inequalities and reducing, by the one or more processors, a sum infeasibility of the homogeneous system of linear inequalities, the resolving further including: reducing constraints with the maximum infeasibility by performing zero-crossing tests which at least preserve or reduce the maximum infeasibility or the sum infeasibility, wherein reducing the maximum infeasibility, reducing the sum infeasibility, and reducing the constraints with the maximum infeasibility are performed recursively until the constraints that remain are feasible; and simulating, by the one or more processors, air traffic control at the predetermined future point of time by utilizing the generated second airspace sector information and the second aircraft traffic information.

2. The computer-implemented method of claim 1, wherein the resolving further includes: increasing, by the one or more processors, a gain of the reduction of the maximum in feasibility.

3. The computer-implemented method of claim 1, wherein the comfiguring a homogeneous system of linear inequalities comprises forming a homogeneous self-dual linear program, and wherein the resolving further includes reducing a maximum infeasibility of the homogeneous self-dual linear program and reducing a sum infeasibility of the homogeneous self-dual linear program.

4. The computer-implemented method of claim 3, wherein the forming comprises: configuring, by the one or more processors, one or more linear inequalities corresponding to a maximization of a primal goal;

configuring, by the one or more processors, one or more linear inequalities corresponding to a minimization of the dual of the primal goal; and configuring, by the one or more processors, one or more linear inequalities corresponding to an equalization of the primal goal to the dual.

5. The computer-implemented method of claim 1, wherein the resolving comprises: generating, by the one or more processors, two or more sub-programs from the homogeneous system of linear inequalities; separately finding solutions to each of the two or more sub-programs, by the one or more processors; and combining, by the one or more processors, the separately found solutions to obtain a solution to the homogeneous system of linear inequalities.

6. The computer-implemented method of claim 5, wherein the separately finding solutions comprises: recursively resolving, by the one or more processors, each of the said two or more sub-programs.

7. The computer-implemented method of claim 5, wherein the generating comprises: determining, by the one or more processors, an area over which the airspace sector information is defined; dividing by the one or more processors, the area to two or more sub-areas, wherein each of the sub-areas is associated with one of the sub-programs.

8. The computer-implemented method of claim 7, wherein the area is divided along a minimum cut set, wherein the minimum cut set is determined based upon two or more clusters of tightly interacting aircraft.

9. The computer-implemented method of claim 5, wherein two or more of the sub-programs are resolved in parallel.

10. The computer-implemented method of claim 1, wherein the aircraft traffic information includes a current location and a flight plan for respective aircraft.

11. The computer-implemented method of claim 1, wherein the aircraft traffic information includes one or more of a separation distance among aircraft, and performance limits of aircraft.

12. The computer-implemented method of claim 1, wherein the airspace sector information includes airspace sector boundaries, entry and exit coordinates for respective airspace sectors.

13. The computer-implemented method of claim 1, wherein the resolving is directed to maximizing forward progress.

14. The computer-implemented method of claim 13, wherein the resolving is further directed to minimizing airspace sector complexity.

15. The computer-implemented method of claim 14, wherein the airspace sector complexity of an airspace sector is determined based upon at least one of, number of maneuvers for aircraft in the airspace sector, delay incurred in maneuvering aircraft in the airspace sector, and effort incurred in maneuvering aircraft in the airspace sector.

16. The computer-implemented method of claim 1, wherein the second airspace sector information includes one or more airspace sector complexity metrics, and wherein the second aircraft traffic information includes one or more resolved aircraft trajectories.

17. The method of claim 1, wherein the resolving is performed based on at least a set of nonzero coefficients that define the homogeneous system of linear inequalities.

18. The method of claim 1, wherein the reducing the maximum infeasibility, reducing the sum infeasibility, and reducing constraints with the maximum infeasibility are each adjusted during a recursive step.

19. A system for simulating aircraft traffic control comprising:

a memory;

one or more processors;

a first processor component coupled to the memory and configured to:

receive as input, airspace sector information and aircraft traffic information, wherein the airspace sector information imposes a plurality of sector restrictions associated with an aircraft;

a second processor component coupled to the memory and configured to configure a homogeneous system of linear inequalities based upon the airspace sector information and aircraft traffic information;

and a third processor component coupled to the memory and configured to resolve the homogeneous system of linear inequalities to generate a second airspace sector information and a second aircraft traffic information, wherein the second airspace sector information and the second aircraft traffic information are based upon a predetermined future point of time, and wherein the resolving includes at least one of:

reducing a maximum infeasibility of the homogeneous system of linear inequalities and reducing a sum infeasibility of the homogeneous system of linear inequalities;

the resolving further includes: reducing constraints with the maximum infeasibility by performing zero-crossing tests which at least preserve or reduce the maximum infeasibility or the sum infeasibility, wherein reducing the maximum infeasibility, reducing the sum infeasibility, and reducing the constraints with the maximum infeasibility are performed recursively until the constraints that remain are feasible; and simulating air traffic control at the predetermined future point of time by utilizing the generated second airspace sector information and the second aircraft traffic information.

20. The system of claim 19, wherein the configuring a homogenous system of linear inequalities comprises forming a homogeneous self-dual linear program, and wherein the resolving further includes recursively reducing a maximum infeasibility of the homogeneous self-dual linear program and reducing a sum infeasibility of the homogeneous self-dual linear program.

21. A non-transitory computer readable media storing instructions wherein said instructions when executed by one or more processors, are adapted to cause the one or more processors to determine air traffic control information according to a method comprising:

receiving as input, by the one or more processors, airspace sector information and aircraft traffic information, wherein the airspace sector information imposes a plurality of sector restrictions associated with an aircraft;

configuring, by the one or more processors, a homogeneous system of linear inequalities based upon the airspace sector information and aircraft traffic information; and resolving, by the one or more processors, the homogeneous system of linear inequalities to determine a second airspace sector information and a second aircraft traffic information, wherein the second airspace sector information and the second aircraft traffic information are based upon a predetermined future point of time, and the resolving including at least one of: reducing, by the one or more processors, a maximum infeasibility of the homogeneous system of linear inequalities; and reducing by the one or more processors, a sum infeasibility of the homogeneous system of linear inequalities; and the resolving further including: reducing, by the one or more processors constraints with the maximum infeasibility by performing zero-crossing tests which at least preserve or reduce the maximum infeasibility or the sum infeasibility, wherein reducing the maximum infeasibility, reducing the sum infeasibility, and reducing the constraints with the maximum infeasibility are performed recursively until the constraints that remain are feasible.

* * * * *

UNITED STATES PATENT AND TRADEMARK OFFICE

CERTIFICATE OF CORRECTION

PATENT NO. : 9,251,710 B2
APPLICATION NO. : 13/250572
DATED : February 2, 2016
INVENTOR(S) : Wang et al.

It is certified that error appears in the above-identified patent and that said Letters Patent is hereby corrected as shown below:

In the Claims

In column 16, line 24, replace “in feasibility” with --infeasibility--.
In column 16, line 26, replace “comfigured” with --configured--.
In column 16, line 58, replace “dividing by” with --dividing, by--.
In column 18, line 50, replace “processors constraints” with --processor, constraints--.

Signed and Sealed this
Third Day of May, 2016

Michelle K. Lee

Michelle K. Lee
*Director of the United States Patent and Trademark Office*